United States Patent [19]

Rathel

[11] 4,068,322

[45] Jan. 17, 1978

[54] PANTYHOSE MENDER

[76] Inventor: Lori A. Rathel, 1035 Sutter St., Apt. 34, San Francisco, Calif. 94109

[21] Appl. No.: 745,055

[22] Filed: Nov. 26, 1976

[51] Int. Cl.[2] ..... A41B 11/02

[52] U.S. Cl. ..... 2/239; 2/243 R; 2/409; 156/94

[58] Field of Search ..... 2/409, 239, 243 R, 240, 2/241; 156/94, 98, 97; 24/90 HA

[56] References Cited

U.S. PATENT DOCUMENTS

| | | | |
|---|---|---|---|
| 1,581,067 | 4/1926 | Kleindienst | 2/241 X |
| 2,116,008 | 5/1938 | Block | 156/94 |
| 2,596,965 | 5/1952 | Troy | 2/239 |
| 2,667,004 | 1/1954 | Sanson | 2/239 X |
| 2,681,877 | 6/1954 | Seymour | 156/94 X |
| 2,826,760 | 3/1958 | Rice | 2/239 X |
| 3,261,393 | 7/1966 | Templeton | 156/94 |

*Primary Examiner*—H. Hampton Hunter
*Attorney, Agent, or Firm*—Robert Charles Hill

[57] ABSTRACT

A pantyhose mender suitable for repairing runs and snags in pantyhose is provided with two substantially identically shaped pieces for placement on the outside and inside of the pantyhose in adhesively back to back relationship.

5 Claims, 3 Drawing Figures

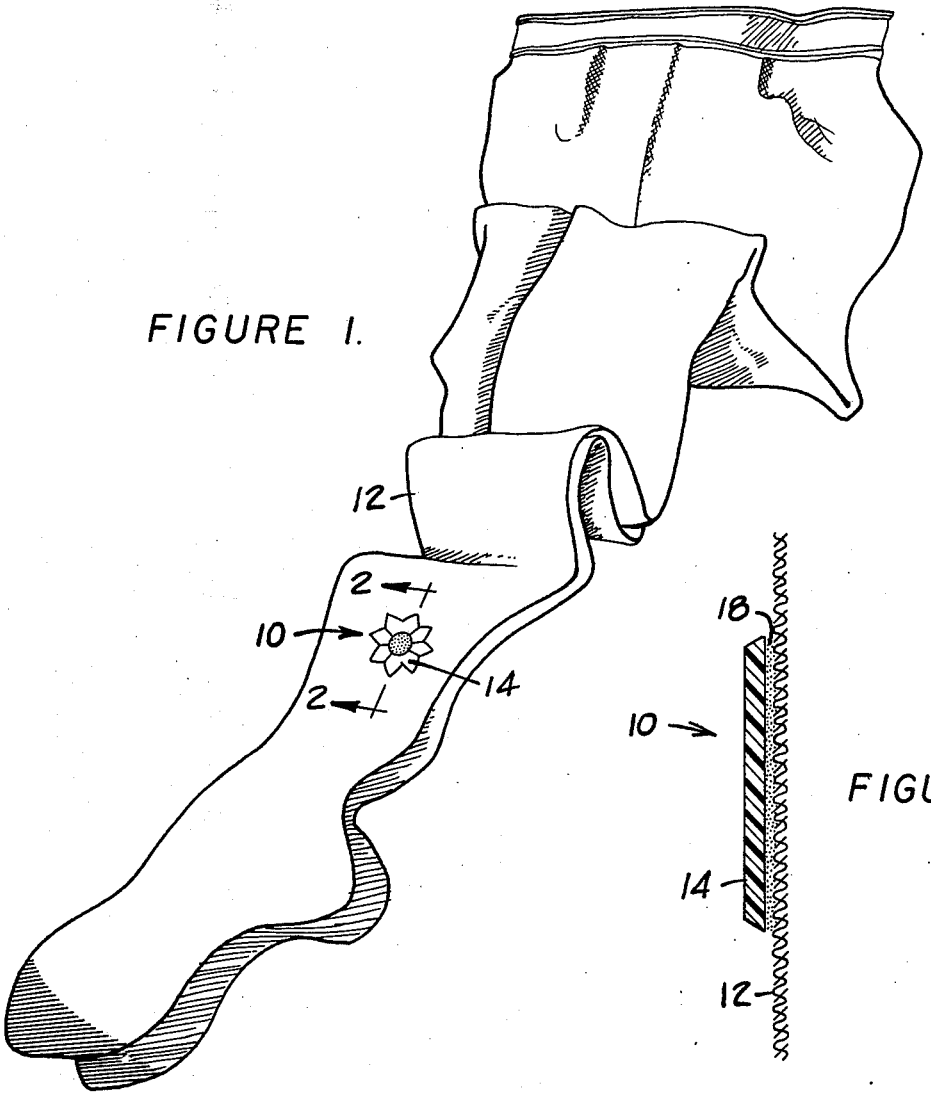
FIGURE 1.
FIGURE 2.
FIGURE 3.
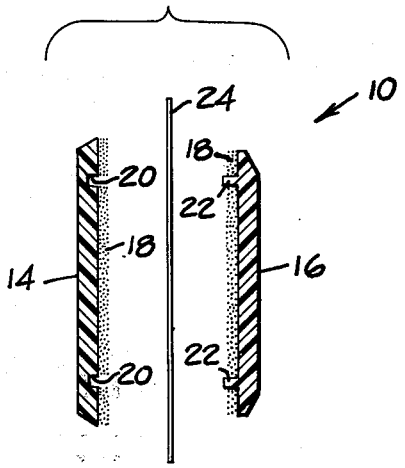

PANTYHOSE MENDER

SUMMARY OF THE INVENTION

The present invention relates to a structure for and method of repairing runs and snags in pantyhose. A pantyhose mender has a decorative mending device for placement over the snag or run on the outside of the pantyhose and a matching piece for placement over the snage or run on the inside of the pantyhose. Each member has a waterproof adhesive on the inside surface thereof allowing the members to be adhesively pressed together to decoratively repair the snag or run.

BACKGROUND OF THE INVENTION

Pantyhose continue to have widespread acceptance as a suitable form of leg covering for women. The cost of pantyhose range from around $2.00 to over $10.00 depending upon the quality, size and color of the material. Just one snag or run and the pantyhose are usaully discarded. That can amount to a sizeable expenditure, especially when the snage or run appears on the first day of wearing. Curiously enough, there is no known commercially available pantyhose mender which will both decorate and repair runs and snags.

Careful analysis of the problems encountered with the existing prior art structures led to the conclusion that the ideal pantyhose mender should be decorative, easy to apply without the use of heat, and protective on both sides of the stocking. Unfortunately, as will be seen below, none of the prior art devices possesses all of these desired attributes.

U.S. Pats. Nos. 2,569,398, 2,596,965 and 2,667,004 all relate to ornamental stockings whereby metal, glass, gems and like jewelry pieces can be applied thereto. These patents do not mend pantyhose.

U.S. Pat. No. 2,601,115 applies a transfer to a special reinforced section of the stocking. The present invention can be used on an existing pantyhose on the market and does not require a specialized stocking.

U.S. Pat. No. 3,772,114 relates to a complicated process for mending fabrics and could not be easily applied on the spot like the present invention.

U.S. Pat. No. 3,135,442 calls for applying heat to an indicia bearing means to effect a transfer onto the leg apparel.

A common way of initially sealing a snag is to apply a clear fingernail enamel thereto. This method looks tacky as the snag is still observable and only lasts for a short period of time.

The present invention eliminates all of the problems inherent in the above described disclosures. The present invention has a decorative outside front surface to enhance the aesthetic appearance of the pantyhose, utilizes a waterproof adhesive requiring no heat for application, and has a matching backpiece so both the inside of the pantyhose are repaired.

OBJECTS OF THE INVENTION

It is the primary object of the present invention to provide a new and improved pantyhose mender.

Another object is to provide a pantyhose mender which is easy to apply without the use of heat.

A further object is to provide structure which is inexpensive to manufacture and long lasting in usage.

BRIEF DESCRIPTION OF THE DRAWINGS

FIG. 1 is a side elevational view of a pantyhose provided with the pantyhose mender of the present invention.

FIG. 2 is an enlarged section view taken substantially as indicated along line 2—2 on FIG. 1.

FIG. 3 is an exploded perspective view of the pantyhose mender.

DESCRIPTION OF THE PREFERRED EMBODIMENT

Referring to FIGS. 1 through 3 which illustrate the pantyhose mender of the present invention, the pantyhose mender generally indicated 10 is applied to a pantyhose 12 and has a decorative mending device 14 for placement over a run or snag on the outside of the pantyhose 12 and a matching backing piece 16 for placement over the snag or run on the inside of the pantyhose 12. The piece 16 is of the same configuration but preferably a little smaller than device 14. A waterproof adhesive 18 is on the backside of both the decorative mending device 14 and the matching backing piece 16. If desired, the device 14 can have a plurality of apertures 20 and the piece 16 can have a plurality of corresponding extensions 22 so that the piece 16 will be in proper alignment with device 14 when the extensions 22 are within apertures 20. A flexible protective cover sheet 24 is in clinging engagement with the adhesive 18 prior to usage.

The decorative mending device 14 may be of any desired color, size and shape. For example, the device 14 may be in the shape of a lovely embroidered rose, a delicate heart, a miniature leaf, a dazzling star, geometric shapes, etc. The possibilities are endless. The device 14 saves the pantyhose for future wearings and as a bonus also makes them pretty.

With the frequency that women go through pantyhose by virtue of the maddening little snags, one could quickly build up a wardrobe of saved, decorative pantyhose in various colors. Pop art could also be incorporated in the design of device 14, like little astrological sign symbols, etc. Of course, the device 14 could be applied without even waiting for the first snag!

The decorative mending device 14 should be made of fabric or some other synthetic material which is flexible and washable. For example, the device 14 may be thin rubber or latex, synthetic plastic film, such as polyethylene, polypropylene, polyvinyl chloride, and the like.

The adhesive 18 should function merely by pressure without requiring heat or other activating means. The adhesive 18 employed should result in a strong fusion or bonding of the device 14 and piece 16 to the pantyhose 12 and should when dried and set have a sufficiently high resistance to heat and detergents and the like, which are normally employed in the washing of pantyhose, to withstand exposure to the usual washing an cleaning operations without deterioration. Additionally, the adhesive 18 cannot be harmful to the skin and should adhere well to the pantyhose 12 which are knit of a synthetic thermoplastic yarn such as nylon or rayon and have an extremely fine mesh, as for example, 60 or 66 guage and 15 denier.

The flexible protective covering sheet 24 is disposed intermediate the adhesive layers 18 to protect them from dirt, grease, etc., which might interfere with the ultimate formation of a bond. Sheet polyethylene or the like is a preferred cover sheet material since it will cling to the surface of the adhesive 18 although there is no evidence of an adhesive bond being formed therebetween.

In actual operation and when the first snag is noticed, the device 14 is removed from the sheet 24 and applied over the snag with some pressure to stop any run from developing. When the pantyhose 12 can be removed from the legs, then piece 16 is removed from sheet 24 and applied to the inside of the pantyhose 12 with extensions 22 fitting within apertures 20 of device 14. Of course, if the pantyhose can be removed immediately after the snag is noticed, then the device 14 and piece 16 can be applied at the same time and pressed toward each other to ensure good adhesion. In this manner there is perfect alignment and the piece 16 will not overlap device 14 and will not be visible when the pantyhose 12 are worn again. The pantyhose mender 10 has transformed an ordinary snagged pair of pantyhose into an aesthetically pleasing pair suitable for further wearing.

It will be obvious that numerous modifications and variations are possible for the above described pantyhose mender within the scope of the present invention. The foregoing, description, as setting forth various constructional and operational details for purposes of understanding only, is not to be taken as limiting the scope of the present invention which is defined only by the following claims.

I claim:

1. The method of mending a snag in a pantyhose which is formed of a thermoplastic material, comprising placing a decorative mending device over the snag on the outside of said pantyhose and affixing said device to said pantyhose, placing a matching backing piece over the snag on the inside of said pantyhose and affixing said piece to said pantyhose, and applying pressure to said decorative mending device and said matching backing piece to permanently secure said device and said piece to each other and to said pantyhose.

2. A pantyhose mender for repairing a snag in a pantyhose comprising first and second spaced-apart contacting members for contacting portions of the opposite sides of said pantyhose at locations adjacent said snag, both of said contacting members having one side with a waterproof adhesive thereon, and engaging means on each of said adhesive sides for cooperatively aligning the first contacting member with the second contacting member.

3. The pantyhose mender of claim 2 wherein the engaging means comprises corresponding apertures and extensions.

4. The pantyhose mender of claim 3 wherein the apertures are on the first contacting member.

5. The pantyhose mender of claim 3 wherein the extensions are on the first contacting member.

* * * * *